US007369110B2

(12) United States Patent
Moon

(10) Patent No.: US 7,369,110 B2
(45) Date of Patent: May 6, 2008

(54) MOBILE DISPLAY MODULE

(75) Inventor: Joon Il Moon, Kyoungki-do (KR)

(73) Assignee: Boe Hydis Technology Co., Ltd., Kyoungki-do (KR)

( * ) Notice: Subject to any disclaimer, the term of this patent is extended or adjusted under 35 U.S.C. 154(b) by 618 days.

(21) Appl. No.: 10/932,383

(22) Filed: Sep. 2, 2004

(65) Prior Publication Data

US 2005/0140627 A1 Jun. 30, 2005

(30) Foreign Application Priority Data

Dec. 30, 2003 (KR) ..... 10-2003-0100218

(51) Int. Cl.
*G09G 3/36* (2006.01)

(52) U.S. Cl. ..... 345/98; 345/87

(58) Field of Classification Search ..... 345/87, 345/89, 98, 99, 100, 204; 348/14.12, 14.15, 348/220.1

See application file for complete search history.

(56) References Cited

U.S. PATENT DOCUMENTS 5,546,104 A * 8/1996 Kuga ..... 345/99
5,828,367 A 10/1998 Kuga
6,839,048 B2 * 1/2005 Park ..... 345/89
7,239,297 B2 * 7/2007 Tajima et al. ..... 345/89
2003/0085859 A1 5/2003 Lee
2004/0258312 A1 * 12/2004 Sim ..... 382/219

FOREIGN PATENT DOCUMENTS

KR 20020073353 9/2002

* cited by examiner

*Primary Examiner*—Richard Hjerpe
*Assistant Examiner*—Kevin M Nguyen
(74) *Attorney, Agent, or Firm*—Ladas & Parry LLP

(57) ABSTRACT

Disclosed is a mobile display module capable of displaying optimal still images or moving pictures depending on characteristics of images to be displayed. The mobile display module includes a graphic memory for storing image data, a data latch unit for latching the image data outputted from the graphic memory, a driver for applying the image data to a liquid crystal panel, a data discrimination unit for determining whether the image data inputted into the graphic memory is still image data or moving picture data, and a gamma voltage generating unit receiving control signals to output first gamma voltage adaptable for the moving picture data to the driver if the image data are the moving picture data and to output second gamma voltage adaptable for the still image data to the driver if the image data are the still image data.

1 Claim, 4 Drawing Sheets

MOBILE DISPLAY MODULE

BACKGROUND OF THE INVENTION

1. Field of the Invention

The present invention relates to a display module, and more particularly to a mobile display module capable of displaying images depending on characteristics of images to be displayed by supplying first gamma voltage adaptable for still images or second gamma voltage adaptable for moving pictures when displaying the still images or moving pictures.

2. Description of the Prior Art

As information and communication technologies have been developed, markets for portable mobile phones have been rapidly grown, so a user may not only make communication with other users, but also access to an Internet and process a great amount of data by using the portable mobile phone. Accordingly, markets for LCDs of portable mobile phones have been significantly changed in order to improve quality of images displayed in an LCD while economizing power consumption.

As shown in FIG. 1, a data processing section of a conventional mobile display module mainly includes a driver 1 for applying image data to a liquid crystal panel, a graphic RAM 3 for receiving images from an exterior and storing such images therein, a data latch unit 5 for latching image data outputted from the graphic RAM 3 and outputting such image data to the driver 1, and a gamma voltage generating unit 7 for outputting gamma voltage to the driver 1.

According to the conventional mobile display module having the above-mentioned construction, the gamma voltage generating unit 7 outputs gamma voltage, which is programmed as a fixed value regardless of image data (still image data or moving picture data) stored in the graphic RAM 3, to the driver 1.

Upon receiving the gamma voltage from the gamma voltage generating unit 7, the driver 1 applies image data inputted thereto from the data latch unit 5 to the liquid crystal panel so that an image is displayed in the liquid crystal panel.

However, the characteristics of data to be displayed are not considered in the conventional mobile display module. That is, the conventional mobile display module displays images regardless of characteristics of still image data or moving picture data, even though it is necessary to deal with the still images discriminately from the moving pictures in order to display optimal images.

Conventionally, still images are mainly displayed in the mobile display module. However, as mobile phone technology has been developed, mobile phones may display moving pictures in addition to still images. Nevertheless, a conventional mobile display module may apply gamma voltage having a fixed value to the driver regardless of characteristics of still image data or moving picture data to be displayed in the liquid crystal panel, so it is impossible to display optimal still images or moving pictures.

SUMMARY OF THE INVENTION

Accordingly, the present invention has been made to solve the above-mentioned problems occurring in the prior art, and an object of the present invention is to provide a mobile display module capable of displaying optimal still images or moving pictures depending on characteristics of images to be displayed.

In order to accomplish the object, there is provided a mobile display module comprising a graphic memory for storing image data inputted thereto, a data latch unit for latching the image data outputted from the graphic memory, a driver for applying the image data outputted from the data latch unit to a liquid crystal panel upon receiving gamma voltage, a data discrimination unit for determining whether the image data inputted into the graphic memory is still image data or moving picture data, and a gamma voltage generating unit receiving control signals in order to output first gamma voltage adaptable for the moving picture data to the driver if the image data are the moving picture data and in order to output second gamma voltage adaptable for the still image data to the driver if the image data are the still image data.

According to the preferred embodiment of the present invention, the data discrimination unit includes a comparator for comparing image data of an $n^{th}$ frame of the graphic memory with image data of an $(n+1)^{th}$ frame positioned at a middle part of the graphic memory and outputting a comparing result to the gamma voltage generating unit.

If the image data of the $n^{th}$ frame are identical to the image data of the $(n+1)^{th}$ frame, the data discrimination unit determines that the image data are the still image data, if the image data of the $(n+1)^{th}$ frame is identical to image data of an $(n+2)^{th}$ frame, the data discrimination unit determines that an application is changed so that the image data is determined as the still image data, and if the image data of the $n^{th}$ frame is not identical to the image data of an $(n+1)^{th}$ frame and the image data of the $(n+1)^{th}$ frame is not identical to the image data of the $(n+2)^{th}$ frame, the data discrimination unit determines that the image data are the moving picture data.

The data discrimination unit includes a first exclusive OR gate receiving first most significant bits of image data positioned in a comparison area of the $n^{th}$ frame and second most significant bits of image data existing in a predetermined position of the $(n+1)^{th}$ frame corresponding to the first most significant bits, a $(m-1)^{th}$ exclusive OR gate receiving first least significant bits of the image data of the $n^{th}$ frame and second least significant bits of the image data of the $(n+1)^{th}$ frame, and an OR gate receiving m number of output data outputted by the first to $(m-1)^{th}$ exclusive OR gates.

The data discrimination unit compares data of a previous frame with data of a present frame and determines that the image data are the moving picture data if a difference between the data of the previous frame and the data of the present frame exceeds a reference value and determines that the image data are the still image data if the difference is equal to or less than the reference value.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
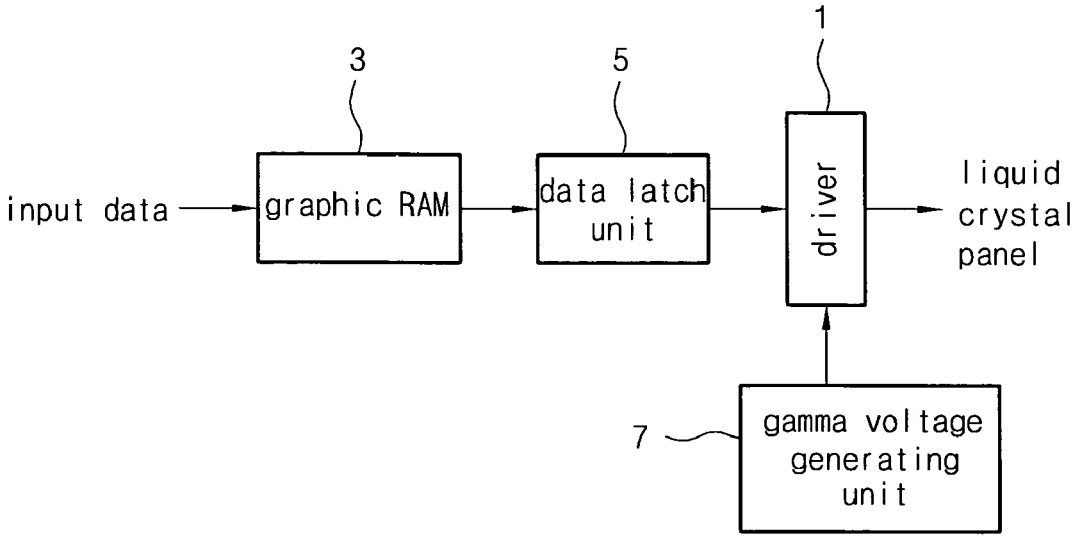
FIG.1 (PRIOR ART)
FIG. 1 is a block view showing a structure of a conventional mobile display module.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
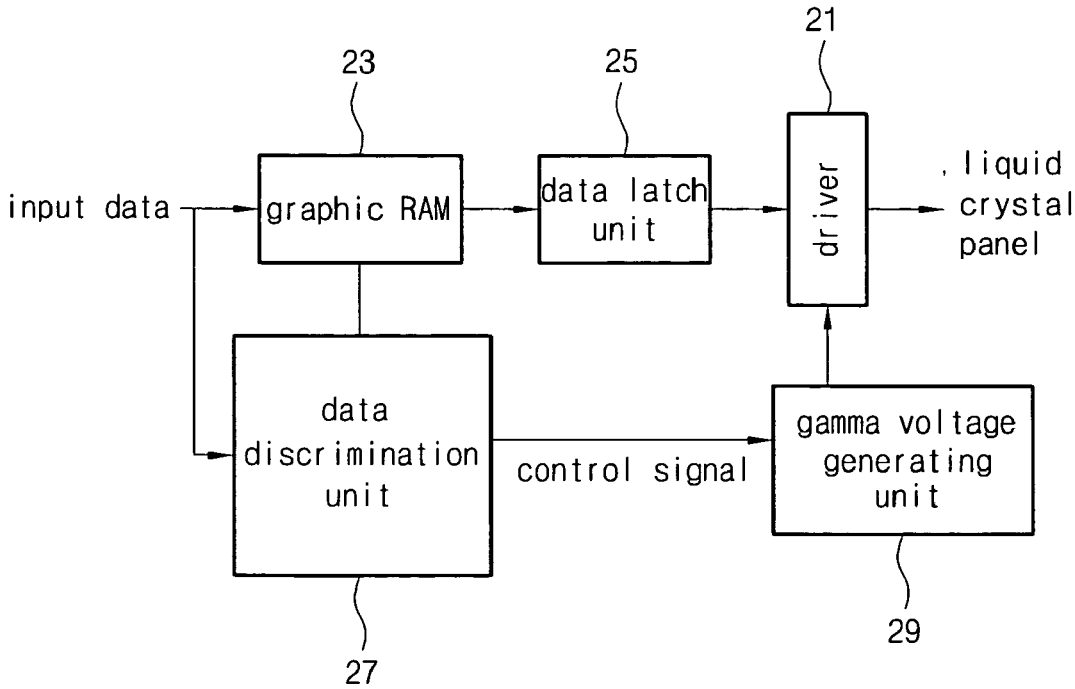
FIG. 2 is a block view showing a structure of a mobile display module according to one embodiment of the present invention.

FIG. 2 is a block view showing a structure of a mobile display module according to one embodiment of the present invention.

As shown in FIG. 2, the mobile display module of the present invention includes a driver 21 for applying image data to a liquid crystal panel, a graphic memory 23 for storing image data inputted thereto, a data latch unit 25 for latching image data outputted from the graphic memory 23, a data discrimination unit 27 determining whether image data inputted into the graphic memory 23 is still image data or moving picture data and outputting control signals depending on a sort of the images data, and a gamma voltage generating unit 29 for outputting gamma voltage to the driver 21 by adjusting a level of the gamma voltage based on the control signals outputted from the data discrimination unit 27.

In a case of a mobile phone, the image data stored in the graphic memory 23 may match with data to be displayed in a ratio of 1:1. That is, data positioned in a left-uppermost part of an area of the graphic memory 23 is displayed in a left-uppermost part of the liquid crystal panel.

Figure 3:
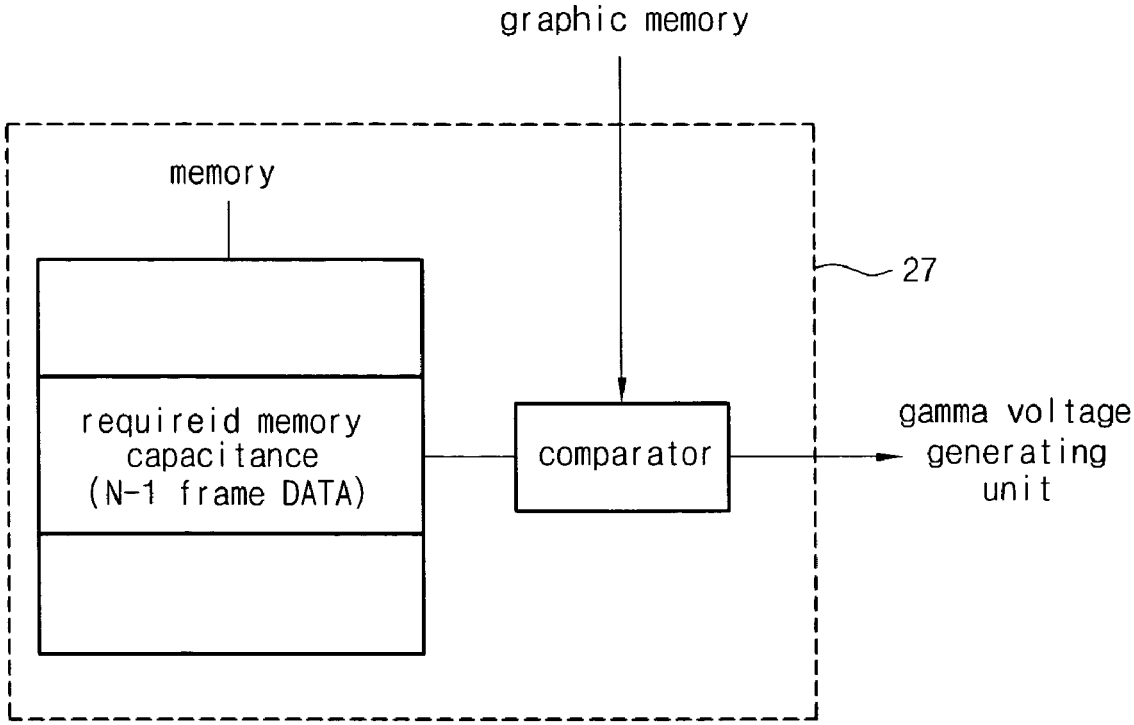
FIG. 3 is a block view showing a structure of a data discrimination unit shown in FIG. 2.

FIG. 3 is a block view showing a structure of the data discrimination unit shown in FIG. 2 in detail. As mentioned above, a position of data stored in the graphic memory 23 is identical to a position of data displayed in the liquid crystal panel. In most cases of mobile phones, information data regarding receiving sensitivity, battery power consumption, date, and time are displayed in an upper portion or a lower portion of the mobile phone.

By using the above application, it is possible to determine whether the image data is the moving picture data or the still image data while using some data existing in an intermediate part of a frame without comparing all of the data of a previous frame with all of the data of a present frame.

Accordingly, image data of an $(n-1)^{th}$ frame only requires some memory area at the intermediate part of the $(n-1)^{th}$ frame rather than a memory area for the whole image data. Since the mobile phone has low resolution, only a little amount of memory is added.

Figure 4:
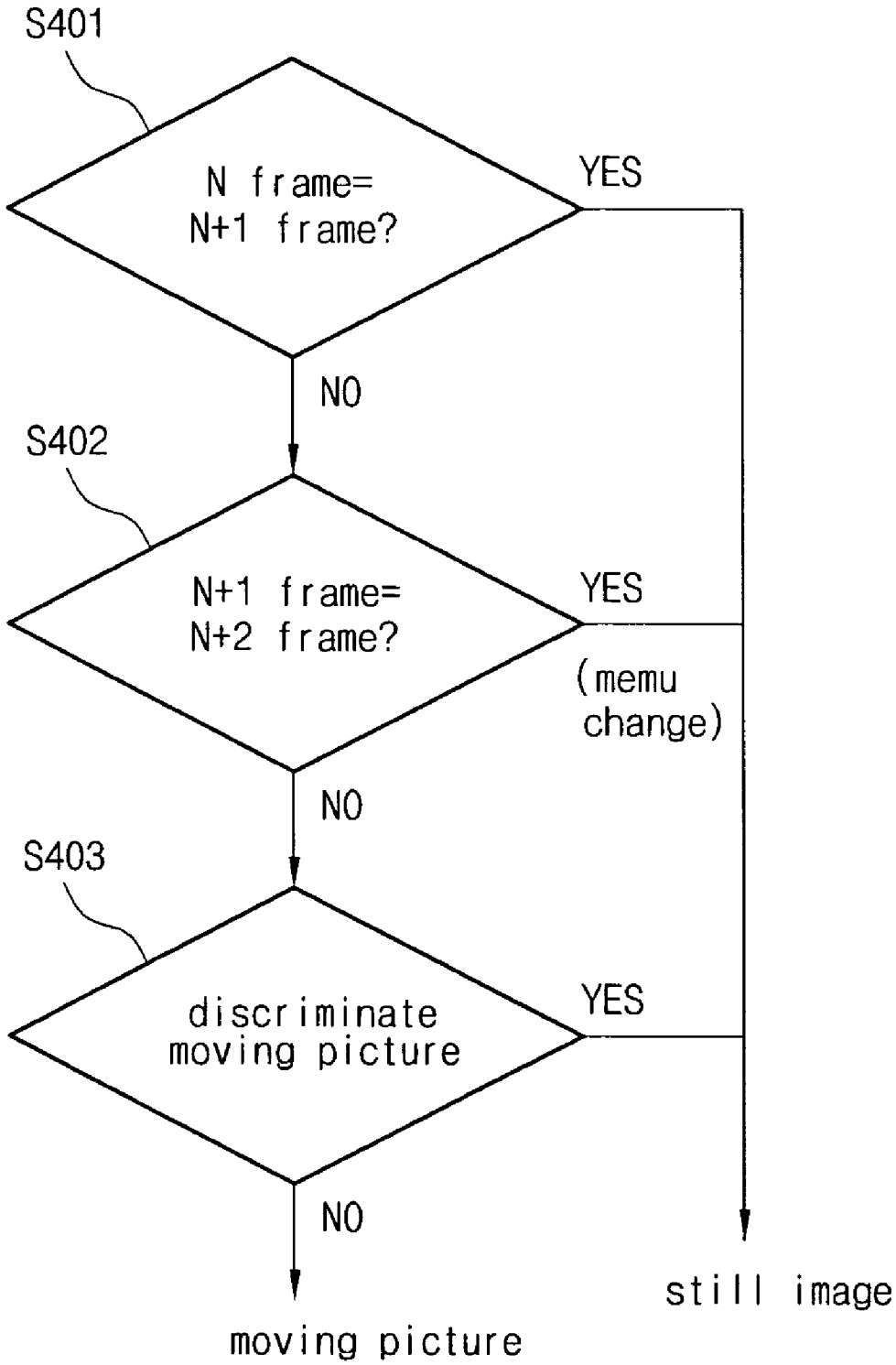
FIG. 4 is a flowchart showing an operation of a data discrimination unit according to one embodiment of the present invention.

That is, as shown in the flowchart of FIG. 4, the data comparison is not carried out over the whole area of the frame, but carried out at the middle part of the frame by comparing image data of an $n^{th}$ frame with image data of an $(n+1)^{th}$ frame. (S401). If the image data of the $n^{th}$ frame are identical to the image data of the $(n+1)^{th}$ frame, the image data is determined as the still image data.

Then, the image data of the $(n+1)^{th}$ frame is compared with the image data of an $(n+2)^{th}$ frame (S402). If the image data of the $(n+1)^{th}$ frame is identical to the image data of the $(n+2)^{th}$ frame, it is determined that an application is changed so that the image data is determined as still image data.

Finally, if the image data of the $n^{th}$ frame is not identical to the image data of an $(n+1)^{th}$ frame and the image data of the $(n+1)^{th}$ frame is not identical to image data of an $(n+2)^{th}$ frame, a value thereof is inputted into the data discrimination unit 27 (S403), thereby determining the image data as moving picture data. Accordingly, gamma voltage adaptable for the moving picture is applied to the driver 21 for displaying the moving picture in the liquid crystal panel.

At this time, the identification of the image data between the previous frame and the present frame may be found by obtaining a difference between data memory areas. If the difference between data memory areas is "0", it is determined that the image data of the previous frame is identical to the image data of the present frame. In order to obtain the difference between data memory areas, an "exclusive OR" in each byte of data is utilized.

Figure 5:
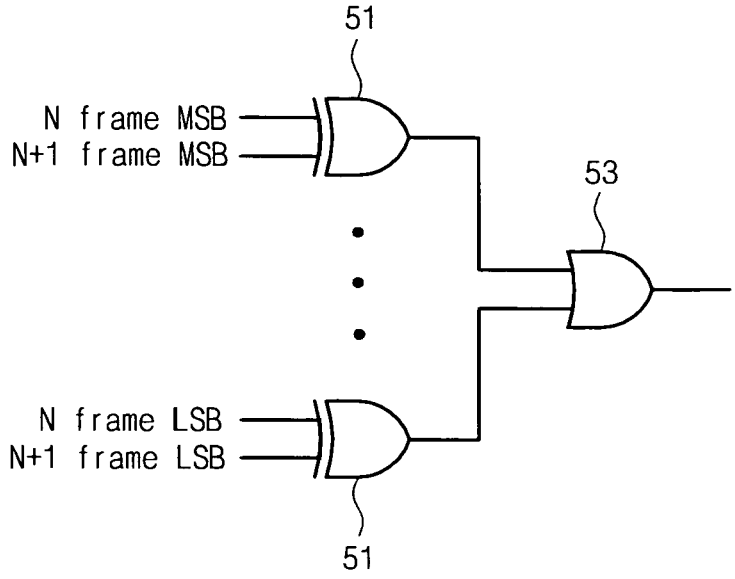
FIG. 5 is a view showing a structure of a data discrimination unit according to one embodiment of the present invention.

For reference, FIG. 5 shows a method for obtaining the difference between data memory areas of frames. Referring to FIG. 5, an exclusive OR gate 51 has characteristics outputting "0" if two kinds of data inputted thereto are identical to each other and outputting "1" if the two kinds of data inputted thereto are different from each other. Accordingly, if output values of the exclusive OR gate 51 obtained by passing memory areas of two frames through an exclusive OR circuit are "0", it is determined that two kinds of image data are identical to each other. In addition, if output values of the exclusive OR gate 51 obtained by passing memory areas of two frames through the exclusive OR circuit are "1", it is determined that two kinds of image data are different from each other.

In practical use, as shown in FIG. 5, data of the $n^{th}$ frame and the $(n+1)^{th}$ frame are inputted into a plurality of exclusive OR gates 51 having the number corresponding to the number of bits in a range from a most significant bit (MSB) to a least significant bit (LSB) for comparing bytes of data with each other. The output values of the exclusive OR gates 51 are inputted into an OR gate 53 for the purpose of use.

The OR gate 53 represents an output value "1", if at least one of output values of the exclusive OR gates 51 is "1". When the output value of the OR gate 53 is "1", it is determined that image data of two frames are different from each other. In addition, when the output value of the OR gate 53 is "0", it is determined that image data of two frames are identical to each other.

In order to determine whether the image data is moving picture data or the still image data, data having an output value "1" are counted from among data outputted through the OR gate 53 shown in FIG. 5. If the number of data having the output value "1" exceeds a predetermined number, it determined that the image data are moving picture data. In addition, if the number of data having the output value "1" is less than the predetermined number, it determined that the image data are still image data.

Figure 6:
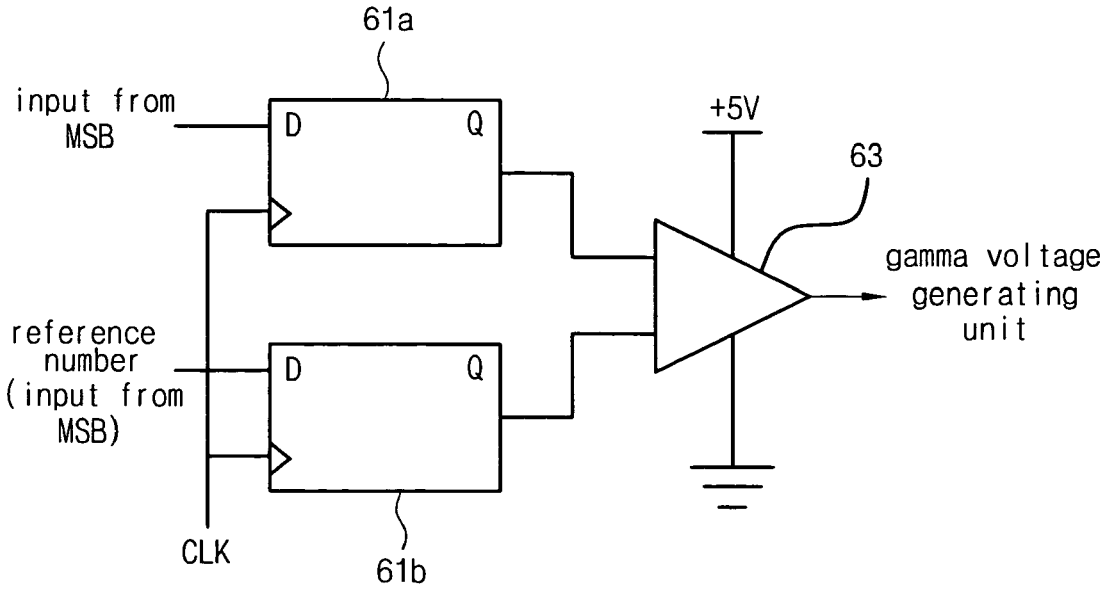
FIG. 6 is a view showing a structure of a data discrimination unit according to another embodiment of the present invention.

Meanwhile, FIG. 6 shows a structure of a data discrimination unit according to another embodiment of the present invention. The data discrimination unit according to another embodiment of the present invention includes two D-flip/flop sections 61*a* and 61*b* and a differential amplifier 63.

Referring to FIG. 6, if an output of the differential amplifier 63 is "1", it is determined that a count value is greater than a reference number. Accordingly, gamma voltage is controlled adaptable for the moving picture or the still image based on the determined value.

For reference, a driver IC for the mobile phone is programmed to control the gamma voltage, it is only required to simply convert a control signal.

As can be seen from the foregoing, the mobile display module according to the present invention has a following advantage.

When displaying an image in a mobile liquid crystal panel, the mobile display module determines whether the image is the moving picture or the still image in such a manner that gamma voltage adaptable for the moving picture or the still image can be supplied to the driver, thereby achieving an optimal image depending on characteristics of image data.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A mobile display module comprising:

a graphic memory for storing image data inputted thereto;

a data latch unit for latching the image data outputted from the graphic memory;

a driver for applying the image data outputted from the data latch unit to a liquid crystal panel upon receiving gamma voltage;

a data discrimination unit for determining whether the image data inputted Into the graphic memory is still image data or moving picture data; and a gamma voltage generating unit receiving control signals in order to output first gamma voltage adaptable for the moving picture data to the driver if the image data are the moving picture data and in order to output second gamma voltage adaptable for the still image data to the driver if the image data are the still image data;

wherein in the image data of the $n^{th}$ frame are identical to the image data of the $(n+1)^{th}$ frame, the data discrimination unit determines that the image data are the still image data, if the image data of the $(n+1)^{th}$ frame is identical to image data of an $(n+2)^{th}$ frame, the data discrimination unit determines that an application is changed so that the image data is determined as the still image data and if the image of the $n^{th}$ frame is not identical to the image data of an $(n+1)^{th}$frame and the image data of the $(n+1)^{th}$ frame is not identical to the image data of the $(n+2)^{th}$ frame, the data discrimination unit determines that the image data are the moving picture data.

* * * * *